US005367893A

United States Patent [19]

Fucík

[11] Patent Number: 5,367,893

[45] Date of Patent: Nov. 29, 1994

[54] SELECTING DEVICE WITH SWINGABLE SELECTING JACK

[75] Inventor: Milan Fucík, Kojetice na Morave, Czech Rep.

[73] Assignee: Uniplet a.s., Trebíc, Czech Rep.

[21] Appl. No.: 19,081

[22] Filed: Feb. 18, 1993

[51] Int. Cl.[5] ..... D04B 9/10

[52] U.S. Cl. ..... 66/222; 66/14; 66/216

[58] Field of Search ..... 66/14, 216, 217, 218, 66/219, 220, 221, 222, 223, 15, 230, 62, 63, 75.2, 106, 38

[56] References Cited

U.S. PATENT DOCUMENTS

| | | | |
|---|---|---|---|
| 2,025,462 | 12/1935 | Lombardi | 66/216 |
| 3,404,546 | 10/1968 | Mishcon | 66/14 |
| 3,709,003 | 1/1973 | Widdowson | 66/221 |
| 3,709,004 | 1/1973 | Paepke | 66/216 |
| 3,866,441 | 2/1975 | Peberby | 66/14 |
| 4,112,712 | 9/1978 | Bini | 66/216 |
| 4,715,198 | 12/1987 | Ploppa et al. | 66/219 |
| 4,739,636 | 4/1988 | Manini | 66/220 |
| 4,989,425 | 2/1991 | Furia | 66/91 |
| 5,174,131 | 12/1992 | Lottenceau et al. | 66/219 |

FOREIGN PATENT DOCUMENTS

| | | |
|---|---|---|
| 1452582 | 10/1976 | United Kingdom . |
| 2173220 | 10/1986 | United Kingdom . |

*Primary Examiner*—Clifford D. Crowder
*Assistant Examiner*—Larry D. Worrell, Jr.
*Attorney, Agent, or Firm*—Notaro & Michalos

[57] ABSTRACT

A selecting device for needles of a circular knitting machine for the production of hosiery goods includes swingable selecting jacks having two guiding butts, one guiding butt at each end, alternately selectable for engagement with cam paths of a needle cylinder. A profile for engagement with a firm push button is formed at one guiding butt above a swinging point of one swingable selecting jack and a profile for engagement with another firm push button is formed on another swingable selecting jack below the swinging point.

1 Claim, 2 Drawing Sheets

SELECTING DEVICE WITH SWINGABLE SELECTING JACK

FIELD AND BACKGROUND OF THE INVENTION

The invention relates in general to a selecting device for a circular knitting machine for the production of hosiery goods, and in particular to a new and useful selecting device for a double-cylinder machine with swingable selecting jacks having two guiding butts alternately selectable for engagement with cam paths.

It is known that in double-cylinder knitting machines for the production of hosiery goods, the knitting is carried out in structures where the needles are divided into both needle cylinders with the exception of the knitting of the heel or toe of the hosiery. This division of the needles is then applied to patterns such as the Jacquard pattern and link-to-link structures. This pattern option is selected in such machines by special inter-jacks with set-out butts both by swinging and sliding jacks or by selection from selecting jacks by the patterning device whereby the selecting jacks are formed as single-arm levers. As a consequence, the patterning device has to actuate every selecting jack in order to provide for all divisions where two adjacent needles are selected for one cylinder. Therefore, the selecting device has to be arranged so that it acts at higher speeds. This arrangement is met for electronic lever devices or mechanical selector devices having numerous patterning butts arranged one above the other. However, this causes a problem in that the height of the needle cylinder is increased and consequently also the weight of the machine is increased.

SUMMARY OF THE INVENTION

The present invention avoids the drawbacks associated with the known knitting device by providing a double cylinder circular knitting machine having selecting jacks alternatively engaged in cam paths. Every other or second jack has a profile on a height level above the swinging point of the jack for engagement with a firm push button. Every first swingable selecting jack has a profile at a height level below the swinging point for engagement with a firm push button. The firm push buttons are arranged in front of the guiding device for engagement with the swingable selecting jacks.

It is an advantage of the invention that in front of the selecting device, the swingable selecting jacks are divided in a 1:1 ratio. That is, a first jack having a profile below the swinging point and a second jack having a profile above the swinging point. Therefore the selecting device can act at every half of the needle jack on every second swingable selecting jack. This provides sufficient space or time for the selection of the jacks.

BRIEF DESCRIPTION OF THE DRAWINGS

A preferred embodiment of the selecting device according to this invention is hereinafter described with reference to the accompanying drawings.

DESCRIPTION OF THE PREFERRED EMBODIMENT

Figure 1:
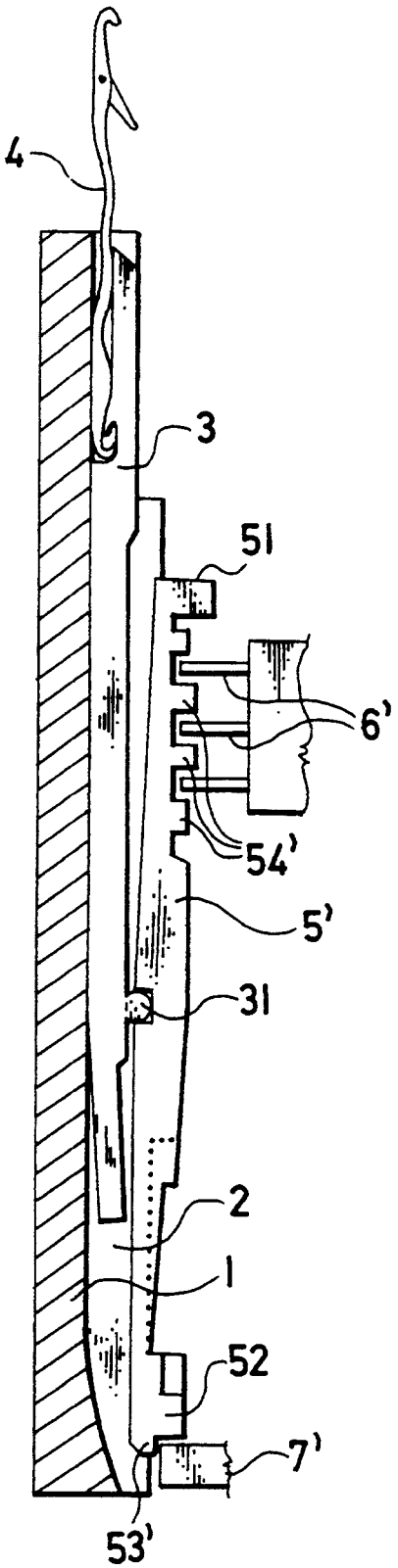
FIG. 1 is a view illustrating a partial axial section of the lower needle cylinder with a needle jack having and a swingable selecting jack an upper butt that is swung out.
Figure 2:
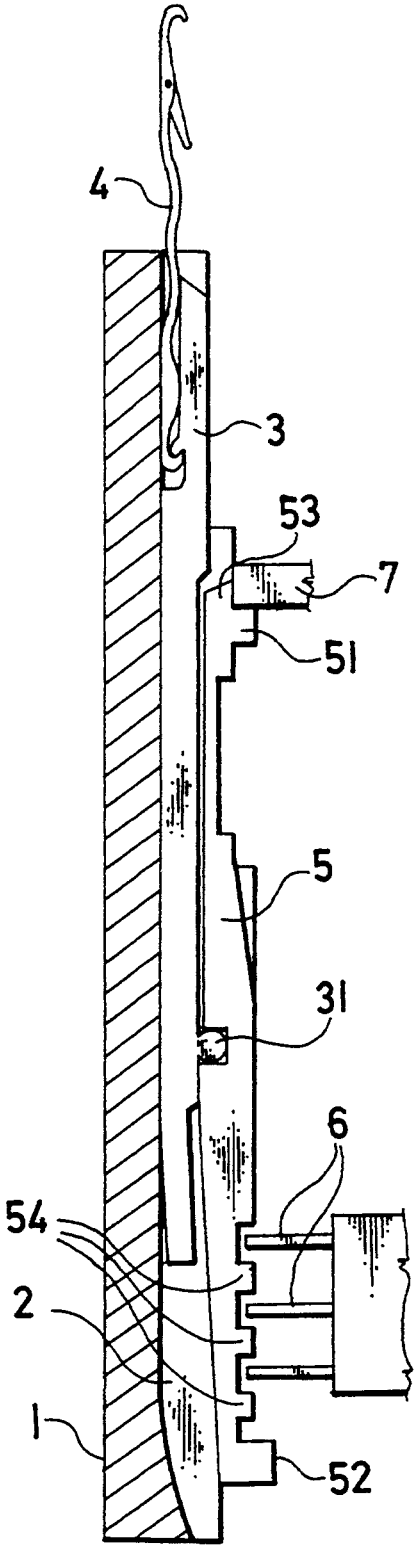
FIG. 2 is a view similar to FIG. 1 of a selecting jack having a lower guiding butt that is swung out.

A double-cylinder circular machine for production of hosiery goods, which is known, is equipped with an upper needle cylinder (not shown) and a lower needle cylinder 1. As shown in FIG. 2, the present invention comprises a lower needle cylinder 1 having a plurality of needle jacks 3 for receiving double-head needles 4 which are placed in longitudinal grooves 2 of the lower cylinder 1. The needle jacks 3 have joints 31, which curves as a swinging point, with the swingable selecting jacks 5 and 5' (FIG. 1) mounted thereon. Each of the swingable selecting jacks 5 and 5' have upper an lower guiding butts 51 and 52 respectively. The present invention uses a plurality of alternating swinging jacks 5 and 5' (FIG. 1), which are odd jacks 5 followed by even jacks 5' (FIG. 1). Above the swinging point 31 of the odd swingable electing jacks 5 there is a profile 53 which is used to push the upper guiding butt 51 of the swingable selecting jacks 5 into the longitudinal grooves 2 of the cylinder 1. Below the swinging point 31 of the odd swingable selecting jacks 5, i.e. opposite the profile 53, are patterning butts 54 formed on the jacks which cooperate with swinging levers 6 of the selecting device. As shown in FIG. 1, the even swingable selecting jacks 5 have profiles 53 provided below the swinging point 31 which push the upper guiding butt 51 of the swingable selecting jacks 5' into the longitudinal grooves 2. Above the swinging point 31 of the even swingable selecting jacks 5', the patterning butts 54' are formed to cooperate with swinging levers 6' of the selecting device.

Figure 3:
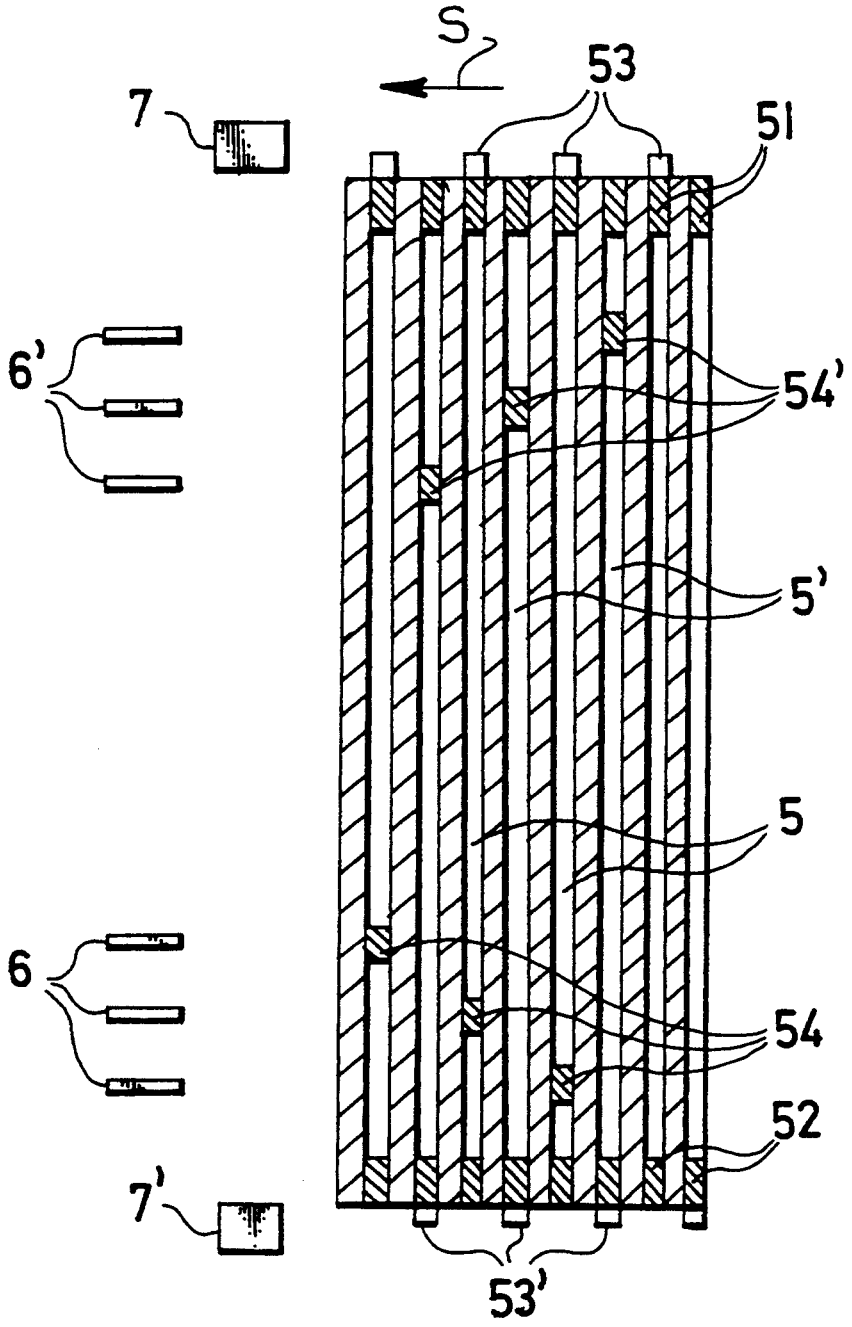
FIG. 3 is a schematic view of the selection of profiles for pushing in the patterning butts on the needle jacks and an arrangement of levers of the selecting device and of the profile push buttons in accordance with the present invention.

As illustrated in FIG. 3, the patterning butts 54 and 54' move in front of the selecting device, i.e. in front of the swinging levers 6 and 6' respectively, at an appropriate level in the direction S such that profiles 53 and 53' of guiding butt 52 are pushed in by fixed push buttons 7 and 7'.

The operation of the present invention is as follows: The swingable selecting jacks 5 and 5' facilitate the knitting system when the odd swingable selecting jacks 5 (FIG. 2) are pushed at their upper end by means of a fixed push button 7 into the longitudinal grooves 2 so that their patterning butts 54 are swung into the swinging levers 6, i.e. in the field of effect of levers 6. At the same time the profiles 53' (FIG. 1) of the even swingable selecting jacks 5' are pushed in so that their patterning butts 54' swing out into the field of effect of the swinging levers 6'. The selecting device then selects the swingable selecting jacks 5 and 5' according to a knitting program causing the guiding butts 51 and 52 to cooperate with the appropriate cam paths.

The selecting device, through its swinging layers 6 and 6', cooperate with every other swingable selecting jacks 5 and 5' respectively which makes it possible to make a selection at higher operating rates.

Within the scope of the invention the swingable selecting jacks can be mounted directly on needles of the one-cylinder knitting machine for the production of hosiery goods because the selection of the needles is also the basis for the knitting of the patterns or untrue ribbs. The swingable selecting jack can also be placed beyond the needle. The profiles 53 and 53' can also be formed at the level of the patterning butts or serve as the patterning butts themselves.

I claim:

1. A selecting device for a circular knitting machine having a plurality of upper and lower cam paths and an upper fixed push button and a lower fixed push button, the device comprising:

a plurality of swinging jacks movably mounted to the machine about a swinging point and movable in a direction, the swinging jacks having an upper guiding butt located above the swinging point at one end of the jack and a lower guiding butt located below the swinging point at an opposite end of the jack;

the swinging jacks being arranged such that one swinging jack is positioned adjacent to another swinging jack, the upper guiding butt of the one swinging jack engaging the upper fixed push button and the lower guiding butt of the other swinging jack engaging the lower fixed push button, the lower guiding butt of the one swinging jack engaging the lower cam path when the upper guiding butt of the one swinging jack engages the upper fixed push button and the upper guiding butt of the other swinging jack engaging the upper cam path when the lower guiding butt of the other swinging jack engages the lower fixed push button;

means for moving the swinging jacks in the direction for causing the engagement with the upper and lower fixed push buttons and the upper and lower cam paths; and a plurality of lower patterning butts near the lower guiding butt of the one swinging jack and a plurality of upper patterning butts near the upper guiding butt of the other swinging jack, the lower and upper patterning butts for engaging the lower and upper cam paths respectively.

* * * * *